US008516716B2

(12) United States Patent
Dal Ben et al.

(10) Patent No.: US 8,516,716 B2
(45) Date of Patent: Aug. 27, 2013

(54) LAUNDRY DRYER WITH GASKET-SUPPORTING COLLAR

(75) Inventors: Diego Dal Ben, Zoppola (IT); Alessandro Vian, Meduna di Livenza (IT)

(73) Assignee: Electrolux Home Products Corporation, N.V., Brussels (BE)

( * ) Notice: Subject to any disclaimer, the term of this patent is extended or adjusted under 35 U.S.C. 154(b) by 200 days.

(21) Appl. No.: 13/208,432

(22) Filed: Aug. 12, 2011

(65) Prior Publication Data

US 2012/0047760 A1 Mar. 1, 2012

(51) Int. Cl.
*F26B 19/00* (2006.01)

(52) U.S. Cl.
USPC ..... 34/601; 34/607; 68/23.4; 62/68; 8/137

(58) Field of Classification Search
USPC ..... 34/77, 599, 601, 604, 607, 610; 68/20, 68/23.4, 3 R; 8/137; 62/68
See application file for complete search history.

(56) References Cited

U.S. PATENT DOCUMENTS

| | | | | |
|---|---|---|---|---|
| 2,547,238 | A * | 4/1951 | Tremblay | 34/603 |
| 2,709,908 | A * | 6/1955 | Altorfer, Jr. et al. | 68/23.4 |
| 3,034,226 | A * | 5/1962 | Conlee | 34/596 |
| 3,078,702 | A * | 2/1963 | Conlee | 68/20 |
| 3,651,580 | A * | 3/1972 | Meyer | 34/602 |
| 3,789,514 | A | 2/1974 | Faust et al. | |
| 3,816,942 | A | 6/1974 | Smith | |
| 4,621,438 | A * | 11/1986 | Lanciaux | 34/77 |
| 5,421,103 | A * | 6/1995 | Wunderlich | 34/599 |
| 6,954,995 | B2 * | 10/2005 | Kitamura et al. | 34/597 |
| 7,559,156 | B2 * | 7/2009 | Renzo | 34/595 |
| 2004/0020246 | A1 * | 2/2004 | Yun et al. | 68/24 |
| 2004/0216326 | A1 * | 11/2004 | Kitamura et al. | 34/597 |
| 2005/0229648 | A1 * | 10/2005 | Kim et al. | 68/20 |
| 2006/0265899 | A1 * | 11/2006 | Renzo | 34/603 |
| 2006/0265959 | A1 * | 11/2006 | Renzo | 49/381 |
| 2008/0110042 | A1 | 5/2008 | Ackermann et al. | |
| 2008/0256988 | A1 * | 10/2008 | Yun et al. | 68/3 R |
| 2009/0301107 | A1 * | 12/2009 | Kammer et al. | 62/68 |

FOREIGN PATENT DOCUMENTS

| | | | |
|---|---|---|---|
| DE | 3132737 | A1 * | 3/1983 |
| DE | 19828243 | A1 * | 12/1999 |
| DE | 199 07 602 | | 8/2000 |

(Continued)

OTHER PUBLICATIONS

Extended European Search Report issued on Mar. 3, 2011 in corresponding European Application No. 10173866.4.

*Primary Examiner* — Steve M Gravini
(74) *Attorney, Agent, or Firm* — Banner & Witcoff, Ltd.

(57) ABSTRACT

A circular sealing gasket can be interposed between a rear rim of a laundry dryer drum tubular body and a rear wall of the dryer casing. The laundry dryer may also comprise a substantially circular, basin-shaped lid or cover fixed to the rear wall, substantially coaxial to the tubular body, so as to form a cavity on the rear wall that communicates with a hot-air generator. A circular gasket-supporting collar may have a nominal diameter greater than that of the tubular body rear rim. The collar may be fixed to the periphery of the basin-shaped lid or cover and/or to the rear wall, coaxial to the tubular body. The circular sealing gasket can be force fitted into the gasket-supporting collar so as to come in abutment against a periphery of the basin-shaped lid or cover around the perimeter thereof.

16 Claims, 3 Drawing Sheets

(56) References Cited

FOREIGN PATENT DOCUMENTS

| | | | | |
|---|---|---|---|---|
| DE | 10 2004 055942 | | | 5/2006 |
| EP | 579069 | A1 | * | 1/1994 |
| EP | 2103732 | A1 | * | 9/2009 |
| EP | 2 145 993 | | | 1/2010 |
| FR | 2621335 | A1 | * | 4/1989 |
| GB | 2098713 | A | * | 11/1982 |
| GB | 2226390 | A | * | 6/1990 |
| JP | 2012217458 | A | * | 11/2012 |

* cited by examiner

LAUNDRY DRYER WITH GASKET-SUPPORTING COLLAR

CROSS-REFERENCE TO RELATED APPLICATION

This application claims priority to European Application No. 10173866.4 filed on Aug. 24, 2010.

FIELD

The present invention relates to a rotary-drum laundry dryer. More specifically, the present invention relates to a rotary-drum home laundry dryer, to which the following description refers purely by way of example without implying any loss of generality.

BACKGROUND

As is known, today's rotary-drum home laundry dryers comprise: a substantially parallelepiped-shaped outer box-like casing structured for resting on the floor; a substantially cylindrical, bell-shaped revolving drum structured for housing the laundry to be dried, and which is housed in an axially rotating manner inside the casing to rotate about its horizontally-oriented longitudinal axis, directly facing a laundry loading/unloading opening formed in the front wall of the casing; a door hinged to the front wall of the casing to rotate to and from a closing position in which the door rests completely against the front wall of the casing to close the laundry loading/unloading opening and airtight seal the revolving drum; and an electric motor assembly structured for driving into rotation the revolving drum about its longitudinal axis inside the casing.

Home laundry dryers of the above type are also provided with an open-circuit or closed-circuit, hot-air generator which is structured to circulate inside the revolving drum a stream of hot air having a low moisture content, and which flows through the revolving drum and over the laundry inside the drum to rapidly dry the laundry; and with an electronic central control unit which controls both the electric motor assembly and the hot-air generator to perform one of the user-selectable drying cycles stored in the same central control unit.

With reference to U.S. Pat. No. 3,789,514 and U.S. Pat. No. 3,816,942, to reduce production costs of the rotary-drum home laundry dryers, in the last years the bell-shaped revolving drum has been replaced by a sleeve-shaped revolving drum which consists of a substantially cylindrical, rigid tubular body structured for resting horizontally inside the appliance casing aligned to the laundry loading/unloading opening, on a number of horizontally-oriented supporting rollers which are located near the two axial ends of the tubular body, and are fixed to the appliance casing in free revolving manner so to allow the tubular body to freely rotate about its horizontally-oriented longitudinal axis.

The front rim of the tubular body is coupled in an airtight and axially rotating manner to the periphery of a funnel-shaped element which extends from the front wall of the appliance casing, towards the tubular body, and is shaped so as to converge to the laundry loading/unloading opening; whereas the rear rim of the tubular body is coupled in an airtight and axially rotating manner directly to the rear wall of the appliance casing.

More specifically, to avoid air leakages from the two axial ends of the tubular body, a first annular sealing gasket is interposed between the front rim of the tubular body and the periphery of the funnel-shaped element on the front wall of the casing, whereas a second annular sealing gasket is interposed between the rear rim of the tubular body and the rear wall of the appliance casing.

In currently marketed rotary-drum home laundry dryers, the first annular sealing gasket is recessed into a circular groove deep-drawn on the periphery of the funnel-shaped element, whereas the second annular sealing gasket is recessed into a circular groove deep-drawn on the rear wall of the appliance casing. Both annular sealing gaskets are firmly glued to the appliance casing, usually on the bottom of the groove, so as to remain stationary when revolving drum rotates about its longitudinal axis, and the front and rear rims of the tubular body scrape in airtight manner against the corresponding annular gasket.

Despite allowing a considerable reduction of the appliance production costs, the removal of the rear wall of the revolving drum has caused a slight reduction of the working life of the laundry dryer.

Long-term working life of this type of rotary-drum home laundry dryer, in fact, is usually conditioned by the lifetime of the two annular sealing gaskets, i.e. by the thickness of the two annular sealing gaskets, and thickness of the annular sealing gasket fixed to the rear wall of the appliance casing is heavily limited by the relatively small depth of the circular groove realizable on the rear wall of the appliance casing.

In today's rotary-drum home laundry dryers, in fact, the relatively small thickness of rear wall of the appliance casing does not allow deep-drawing of very deep circular grooves.

In addition to the above, positioning and gluing of the annular sealing gasket on the bottom of the circular groove realized on the rear wall of the appliance casing is relatively complicated and takes a lot of time during assembly of the laundry dryer, thus partly defeating the production costs savings resulting from the removal of the rear wall of the bell-shaped revolving drum.

SUMMARY

Aim of the present invention is therefore to provide a rotary-drum home laundry drier which is structured to eliminate the drawbacks referred above, and which is additionally less expensive to produce.

In compliance with the above aims, according to the present invention there is provided a rotary-drum laundry dryer comprising an outer casing having a front wall, a rear wall, side walls and a top wall, a rotatable drum structured for housing the laundry to be dried and which is fixed in an axially rotating manner inside the casing, and a hot-air generator which is structured to circulate a stream of hot air through said rotatable drum; the rotatable drum comprising a substantially cylindrical, tubular body having its front rim coupled in axially rotating manner to a front bulkhead, and its rear rim coupled in axially rotating manner to the rear wall of the casing; the laundry dryer also comprising a first circular sealing gasket which is interposed between the front rim of the tubular body and the front bulkhead, and a second circular sealing gasket which is interposed between the rear rim of the tubular body and the rear wall of the casing; the rotary-drum laundry dryer being characterized by also comprising:

- a substantially circular, basin-shaped lid or cover which is fixed to the rear wall of the casing substantially coaxial to the tubular body, so as to form, on said rear wall, a cavity which communicates with the hot-air generator; and
- a circular gasket-supporting collar which has a nominal diameter greater than that of the rear rim of the tubular body, and is fixed to the periphery of the basin-shaped lid or cover and/or to the rear wall of the casing, coaxial to the tubular body;

the second circular sealing gasket being force fitted into the gasket-supporting collar so as to come in abutment against the periphery of the basin-shaped lid or cover around the perimeter of the latter.

Furthermore and preferably, though not necessarily, the rear wall of the casing is provided with a substantially sink-shaped bulge or recess which projects outwards on the casing, is located inside the perimeter of the second sealing gasket, and communicates with the hot-air generator; the basin-shaped lid or cover being fixed to the rear wall of the casing substantially coaxial to the tubular body, so as to close the outwards-projecting bulge or recess realized on the rear wall of the casing.

Furthermore and preferably, though not necessarily, the basin-shaped lid or cover is firmly fixed to the rear wall of the casing in substantially airtight manner.

Furthermore and preferably, though not necessarily, an annular sealing gasket is interposed between the basin-shaped lid or cover and the rear wall of the casing.

Furthermore and preferably, though not necessarily, at least a portion of the basin-shaped lid or cover is properly perforated, or at any rate permeable to air, to permit hot air to flow into the revolving drum or vice versa.

Furthermore and preferably, though not necessarily, the sink-shaped bulge or recess on the rear wall of the casing is substantially circular in shape, and is substantially coaxial to the tubular body; and the basin-shaped lid or cover is fixed to the rear wall of the casing with its concavity directly facing the bottom of the outwards-projecting bulge or recess on the rear wall of the casing, so as to form, on said rear wall, a substantially lenticular-shaped cavity.

Furthermore and preferably, though not necessarily, the central section of the bottom of the basin-shaped lid or cover is provided with a substantially cup-shaped contra-oriented bulge or recess which projects towards the bottom of the outwards-projecting bulge or recess on the rear wall of the casing.

Furthermore and preferably, though not necessarily, the periphery of the basin-shaped lid or cover is fixed to the rear wall of the casing via seam-folding and/or clinching and/or riveting and/or spot-welding or similar.

Furthermore and preferably, though not necessarily, the circular gasket-supporting collar is fixed to the periphery of the basin-shaped lid or cover and/or to the rear wall of the casing via seam-folding and/or clinching and/or riveting and/or spot-welding or similar.

Furthermore and preferably, though not necessarily, the circular gasket-supporting collar is realized in one piece with the basin-shaped lid or cover.

Furthermore and preferably, though not necessarily, the second circular sealing gasket consists of a monolithic, toroidal-shaped ring made of rubber or other elastomeric polymer suitable to be force fitted into the circular gasket-supporting collar.

Furthermore and preferably, though not necessarily, said toroidal-shaped ring has a hollow structure.

Furthermore and preferably, though not necessarily, the basin-shaped lid or cover and/or the circular gasket-supporting collar are made of metal material.

Furthermore and preferably, though not necessarily, the tubular body rests substantially horizontally inside the casing on a number of substantially horizontally-oriented supporting rollers which are located close to both axial ends of the tubular body, and are associated to the casing in free revolving manner so as to allow the tubular body to freely rotate inside the casing about its horizontally-oriented longitudinal axis.

Furthermore and preferably, the outer casing 2 comprises a lower supporting base or socle which is structured for resting on the floor and for housing heat exchanging means adapted to dehydrate the moisture laden air exiting the drum (such as an air-air heat exchanger or an evaporator of a heat pump system); and an upper cabinet which is structured for firmly resting on the lower supporting base or socle; the rotatable drum 3 is fixed in axially rotating manner inside the upper cabinet; the rear wall 10 is the rear wall of the upper boxlike cabinet; and the horizontally-oriented supporting rollers 9 are fixed in free revolving manner directly to the lower supporting base or socle.

Furthermore and preferably, though not necessarily, the hot-air generator is a closed-circuit, hot-air generator which is structured for gradually drawing air from the revolving drum; extracting and retaining the surplus moisture from the hot air drawn from the revolving drum; heating the dehumidified air to a predetermined temperature, normally higher than the temperature of the air arriving from revolving drum; and feeding the heated, dehumidified air back into the revolving drum, where it flows over, to rapidly dry, the laundry inside the drum.

Furthermore and preferably, though not necessarily, the rotary-drum laundry dryer also comprises, inside the casing, a motor assembly which is structured to drive into rotation, on command, the tubular body about its longitudinal axis.

BRIEF DESCRIPTION OF THE DRAWINGS

A non-limiting embodiment of the present invention will now be described, by way of example, with reference to the accompanying drawings, in which.

DETAILED DESCRIPTION OF EXAMPLE EMBODIMENTS

Figure 1:
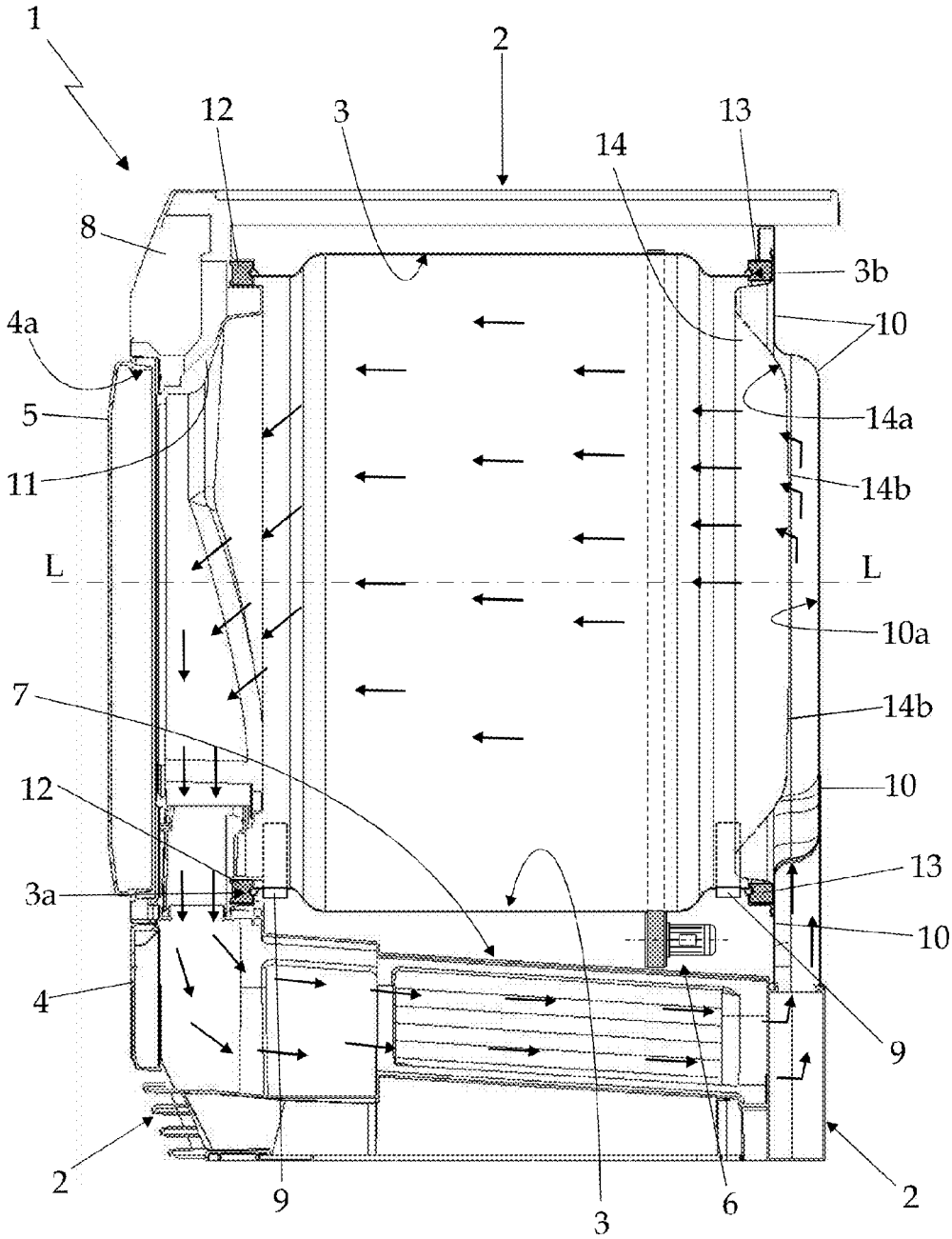
FIG. 1 shows a schematic section view, with parts removed for clarity, of a rotary-drum home laundry dryer realized in accordance with the teachings of the present invention.

With reference to FIG. 1, number 1 indicates as a whole a rotary-drum home laundry dryer which comprises: a preferably, though not necessarily, parallelepiped-shaped outer boxlike casing 2 comprising a front wall 4, a rear wall 10, side walls and a top wall and having structured for resting on the floor; a substantially cylindrical, sleeve-shaped revolving drum 3 structured for housing the laundry to be dried, and which is fixed in axially rotating manner inside casing 2, directly facing a laundry loading/unloading through opening **4*a* formed in front wall 4 of casing 2; and a porthole door 5 hinged to front wall 4 of casing 2 to rotate about a preferably, though not necessarily, vertically-oriented reference axis, to and from a closing position in which door 5 rests completely against front wall 4 to close the laundry loading/unloading opening 4*a* and airtight seal revolving drum 3**.

Moreover, inside casing 2, rotary-drum home laundry dryer 1 also comprises, a motor assembly 6 which is structured to drive into rotation, on command, the revolving drum 3 about its longitudinal axis; an open-circuit or closed-circuit, hot-air generator 7 which is structured to circulate through revolving drum 3, on command, a stream of hot air having a low moisture level, and which flows over and rapidly dries the laundry located inside drum 3; and finally an electronic central control unit 8 which controls both the motor assembly 6 and the hot-air generator 7 to perform, on command, one of the user-selectable drying cycles preferably, though not necessarily, stored in the same central control unit.

Figure 2:
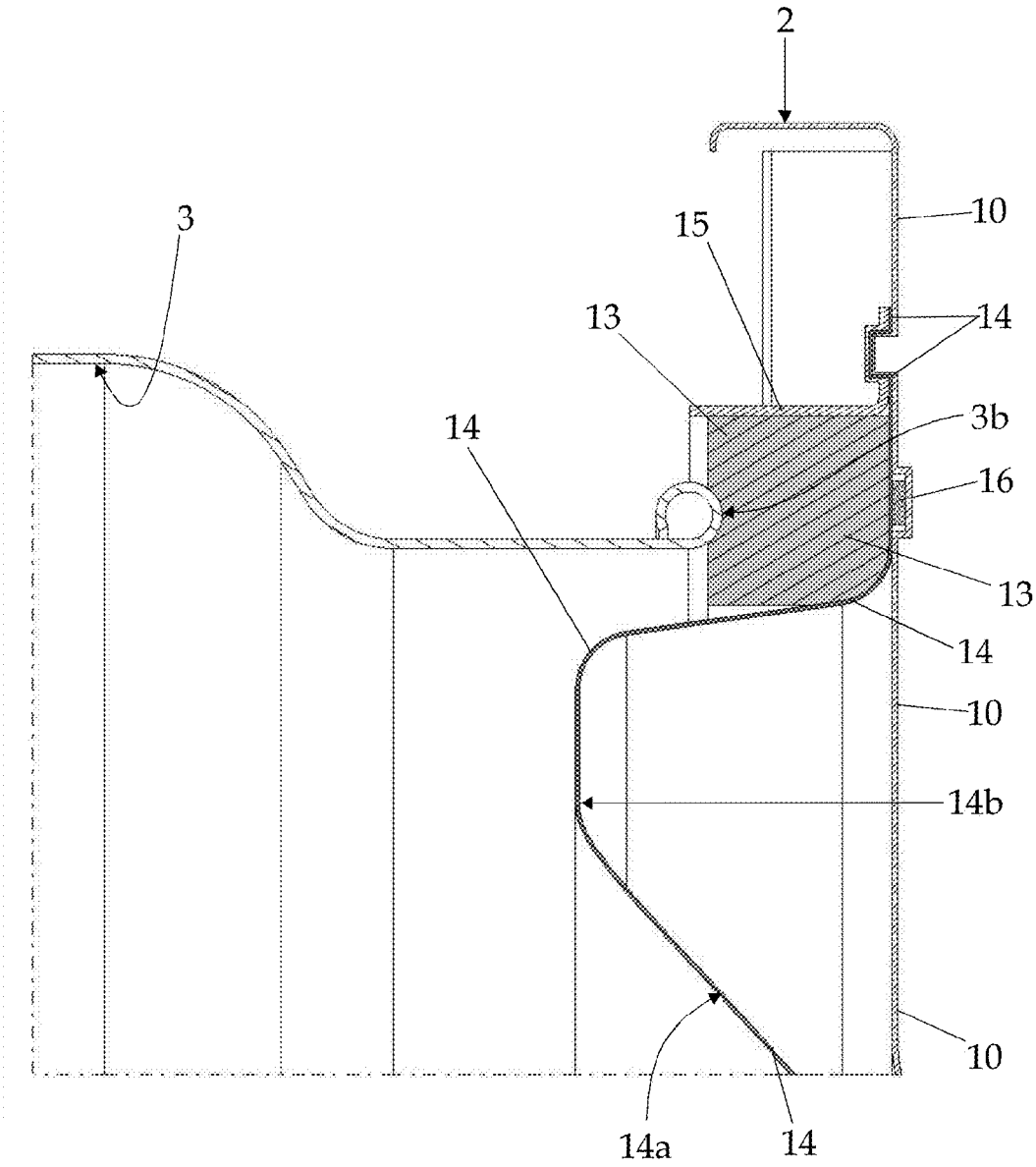
FIG. 2 shows an enlarged view of the upper portion of the rear part of the FIG. 1 rotary-drum home laundry dryer, with parts in section and parts removed for clarity.

Preferably, with reference to the embodiment shown in FIGS. 1 and 2, the sleeve-shaped revolving drum 3 extends inside casing 2 coaxial to a substantially horizontally-oriented longitudinal axis L, and comprises a substantially cylindrical, rigid tubular body 3 which is preferably, though not necessarily, made of metal material such as, for example, stainless steel, and rests substantially horizontally inside the casing 2 on a number of substantially horizontally-oriented supporting rollers 9 which are located close to both axial ends of tubular body 3, and are fixed to casing 2 in free revolving manner so as to allow the tubular body 3 to freely rotate inside the casing about its horizontally-oriented longitudinal axis L.

The front rim 3*a* of tubular body 3 is coupled in a substantially airtight manner and in an axially rotating manner to a front bulkhead, so as to surround the laundry loading/unloading opening 4*a*; whereas the rear rim 3*b* of tubular body 3 is coupled in a substantially airtight manner and in an axially rotating manner to the rear wall 10 of casing 2.

In the example shown, in particular, front rim 3*a* of tubular body 3 is preferably, though not necessarily, coupled in an airtight and axially rotating manner to the periphery of a substantially funnel-shaped element 11 which extends from front wall 4 of casing 2 towards tubular body 3, and is shaped so as to converge to the laundry loading/unloading opening 4*a*; whereas rear rim 3*b* of tubular body 3 is coupled in an airtight and axially rotating manner directly to rear wall 10 of casing 2.

Preferably, with reference to FIGS. 1 and 2, to avoid air leakages from the two axial ends of tubular body 3, rotary-drum home laundry dryer 1 comprises a first circular sealing gasket 12 which is interposed between the front rim 3*a* of tubular body 3 and the periphery of the funnel-shaped element 11; and a second circular sealing gasket 13 which is interposed between the rear rim 3*b* of tubular body 3 and the rear wall 10 of casing 2. Sealing gaskets 12 and 13 are obviously coaxial to tubular body 3 and substantially copy the nominal diameter of, respectively, the front rim 3*a* and the rear rim 3*b* of tubular body 3.

Additionally, in the example shown, circular sealing gasket 12 is preferably, though not necessarily, stationary recessed into a circular groove realized on the periphery of the funnel-shaped element 11 extending from front wall 4 towards revolving drum 3; whereas the second circular sealing gasket 13 is fixed to the rear wall 10 of casing 2.

As regards the hot-air generator 7, with reference to FIG. 1, the stream of hot air produced by the hot-air generator 7 preferably, though not necessarily, enters into revolving drum 3 through the mouth delimited by the rear rim 3*b* of tubular body 3, and leaves revolving drum 3 through the mouth delimited by the front rim 3*a*.

In the example shown, in particular, hot-air generator 7 consists of a closed-circuit, hot-air generator which is structured for gradually drawing air from revolving drum 3; extracting and retaining the surplus moisture from the hot air drawn from revolving drum 3; heating the dehumidified air to a predetermined temperature, normally higher than the temperature of the air arriving from revolving drum 3; and feeding the heated, dehumidified air back into revolving drum 3, where it flows over, to rapidly dry, the laundry inside the drum.

In other words, hot-air generator 7 provides for continuously dehumidifying and heating the air circulating inside revolving drum 3 to rapidly dry the laundry inside the drum.

With reference to FIG. 1, instead, motor assembly 6 preferably, though not necessarily, comprises an electric motor which is mechanically coupled to revolving drum 3 via a pulley and a driving belt which, in turn, is wound on the periphery of tubular body 3.

The electric motor assembly 6 which rotates revolving drum 3 about axis L, and the hot-air generator 7 which circulates hot air through revolving drum 3, are commonly known parts in the laundry-dryers technical field, and therefore won't be described in detail.

Figure 3:
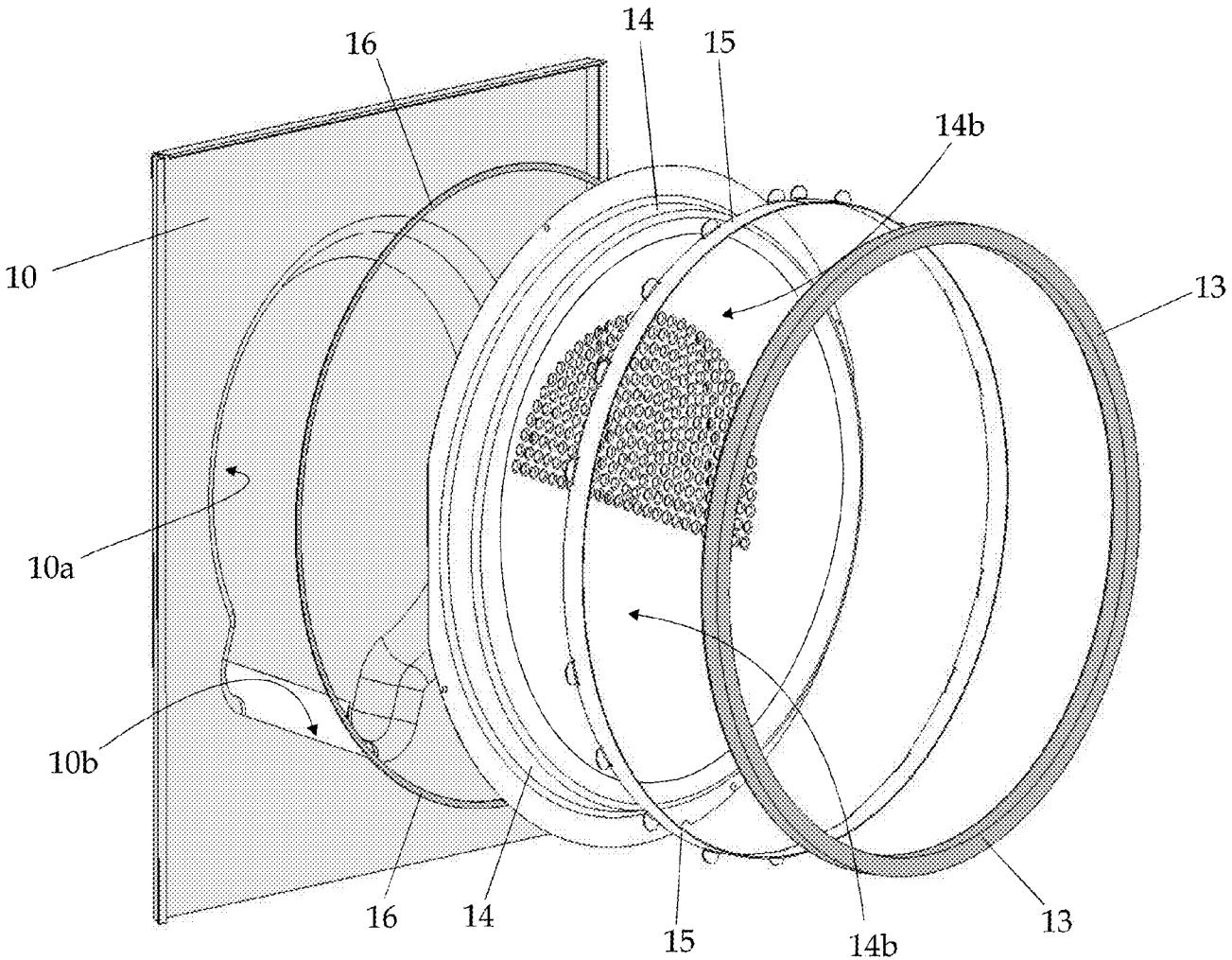
FIG. 3 shows a partly-exploded perspective view of the rear part of the FIG. 1 rotary-drum home laundry dryer, with parts removed for clarity.

With reference to FIGS. 1, 2 and 3, differently from currently marketed rotary-drum home laundry dryers, rear wall 10 of casing 2 is provided with a substantially circular, sink-shaped bulge or recess 10*a* which projects outwards on casing 2 while remaining substantially coaxial to the longitudinal axis L of tubular body 3, has an outer diameter lower than that of sealing gasket 13 and rear rim 3*b*, so as to be located inside the perimeter of sealing gasket 13 and rear rim 3*b*, and is in direct communication with the delivery of hot-air generator 7 via a through opening 10*b* realized roughly on the lower portion of the same bulge or recess 10*a*.

In addition to the above, laundry dryer 1 also comprises a substantially circular, dish- or basin-shaped lid or cover 14 which is firmly fixed to rear wall 10 of casing 2 substantially coaxial to the longitudinal axis L of tubular body 3, and is dimensioned/shaped so as to completely cover and close the outwards-projecting bulge or recess 10*a* of rear wall 10 to form an air duct or passageway for the hot air directed towards revolving drum 3; and a circular gasket-supporting collar 15 which has a nominal diameter greater than that of rear rim 3*b*, and is firmly fixed to the periphery of the basin-shaped lid or cover 14, and/or to the rear wall 10 of casing 2, so as to be coaxial to the longitudinal axis L of tubular body 3.

Both the basin-shaped lid or cover 14 and the gasket-supporting collar 15 are preferably, though not necessarily, made of metal material.

Preferably, basin-shaped lid or cover 14 is firmly fixed to rear wall 10 of casing 2 in substantially airtight manner, with its concavity directly facing the bottom of the outwards-projecting bulge or recess 10*a* of rear wall 10, so as to form, on rear wall 10, a substantially lenticular-shaped cavity which is suited to receive the hot air arriving from hot-air generator 7; whereas at least a portion of the bottom 14*b* of the basin-shaped lid or cover 14 is properly perforated, or at any rate permeable to air, to permit hot air to flow into revolving drum 3 or vice versa.

The circular sealing gasket 13 is force fitted into gasket-supporting collar 15, and is shaped so as to permanently come in abutment against the periphery of the basin-shaped lid or cover 14 without interruption all around the perimeter of the latter, so as to avoid any air leakage from the gap between the rear rim 3*b* of tubular body 3 and the basin-shaped lid or cover 14.

Additionally, the circular sealing gasket 13 is also shaped so as to take up the annular groove delimited by the gasket-supporting collar 15 and the basin-shaped lid or cover 14. In other words, the circular sealing gasket 13 optionally may also force fitted onto the cylindrical sidewall of the basin-shaped lid or cover 14.

In the example shown, in particular, the circular sealing gasket 13 preferably, though not necessarily, consists of a monolithic, toroidal-shaped ring 13 made of rubber or other elastomeric polymer suitable to be force fitted into the circular gasket-supporting collar 15. Optionally, the toroidal-shaped ring 13 may also have a hollow structure, particularly when made of rubber or other elastomeric polymer.

With reference to FIGS. 2 and 3, in the example shown, moreover, the periphery of the basin-shaped lid or cover 14 is permanently fixed to the rear wall 10 of casing 2 preferably, though not necessarily, via seam-folding and/or clinching and/or riveting and/or spot-welding or similar; and an annular sealing gasket 16 is preferably, though not necessarily, interposed between the basin-shaped lid or cover 14 and the rear wall 10 of casing 2 to avoid undesired air leakages from the substantially lenticular-shaped cavity formed on rear wall 10. Obviously the sealing gasket 16 surrounds the entrance or mouth of the outwards-projecting bulge or recess 10*a* on rear wall 10.

Moreover, with reference to FIGS. 1 and 2, in the example shown the central section of the bottom 14*b* of the basin-shaped lid or cover 14 is preferably, though not necessarily, provided with a substantially circular, cup-shaped contra-oriented bulge or recess 14*a* which projects towards the bottom of the outwards-projecting bulge or recess 10*a* of rear wall 10, so to locally reduce the thickness of the lenticular-shaped cavity formed on rear wall 10 and maximize the inner volume of revolving drum 3. Thus the basin-shaped lid or cover 14 has a substantially U-shaped peripheral annular portion which protrudes inside the revolving drum 3, and a substantially cup-shaped central portion which sticks out of revolving drum 3 and protrudes inside the outwards-projecting bulge or recess 10*a* of rear wall 10.

The perforated area of the basin-shaped lid or cover 14 is preferably, though not necessarily, located on the bottom of said contra-oriented bulge or recess 14*a*.

As regards the circular gasket-supporting collar 15, with reference to FIGS. 2 and 3, the rear rim of gasket-supporting collar 15—i.e. the rim of collar 15 faced to rear wall 10—is provided with one or more radially outwards-projecting winglet or flanges, which are structured to be permanently fixed to the periphery of the basin-shaped lid or cover 14 and/or optionally also to the rear wall 10 of casing 2 via seam-folding and/or clinching and/or riveting and/or spot-welding or similar, so as to firmly fix the gasket-supporting collar 15 on the periphery of the basin-shaped lid or cover 14, while remaining coaxial to the longitudinal axis L of tubular body 3.

General operation of the rotary-drum home laundry drier 1 is clearly inferable from the above description, with no further explanation required.

The advantages connected to the particular structure which supports the circular sealing gasket 13, i.e. the basin-shaped lid or cover 14 which closes the bulge or recess 10*a* of rear wall 10, and the gasket-supporting collar 15 which is firmly fixed to the periphery of said basin-shaped lid or cover 14, are large in number.

First of all, the force fitting of circular sealing gasket 13 into the gasket-supporting collar 15, and the subsequent mechanical fixing of the gasket-supporting collar 15 to the periphery of the basin-shaped lid or cover 14, allows a very quick fixing of the circular sealing gasket 13 on the rear wall 10 of casing 2 without the use of glues, adhesives or mechanical anchoring devices.

Furthermore, the annular groove formed by the gasket-supporting collar 15 and the basin-shaped lid or cover 14 is no more limited in shape by the thickness of the rear wall 10—in fact it is no more deep-drawn on the rear wall of the appliance casing, and therefore it can be dimensioned to house a circular sealing gasket 13 having a thickness at least double than that of the circular sealing gaskets used in today's home laundry dryers, thus significantly increasing the long-term working life of this type of rotary-drum home laundry dryer.

Clearly, changes may be made to the rotary-drum home laundry drier 1 as described herein without, however, departing from the scope of the present invention.

For example, in a different non-shown embodiment the circular gasket-supporting collar 15 may be realized in one piece with the basin-shaped lid or cover 14 so as to further speed up the assembly of the rotary-drum home laundry drier 1.

Obviously, the circular sealing gasket 13 is still force fitted into the gasket-supporting collar 15 before mechanically fixing to rear wall 10 the basin-shaped lid or cover 14 integrating collar 15.

Additionally, in a non-shown structural variation the outer boxlike casing 2 may comprise a substantially parallelepiped-shaped lower supporting base or socle which is structured for resting on the floor and for housing heat exchanging means adapted to dehydrate the moisture laden air exiting the drum (such as an air-air heat exchanger or and evaporator of a heat pump system); and of a substantially parallelepiped-shaped upper boxlike cabinet which is structured for firmly resting on the lower supporting base or socle.

In this variation, revolving drum 3 is fixed in axially rotating manner inside the upper boxlike cabinet; the rear wall 10 is the rear wall of the upper boxlike cabinet; and the horizontally-oriented supporting rollers 9 are fixed in free revolving manner directly to the lower supporting base or socle so that the rear wall 10 is free from any supporting rollers.

The invention claimed is:

1. A rotary-drum laundry dryer comprising:

an outer casing having a front wall, a rear wall, side walls and a top wall;

a drum structured for housing laundry to be dried and fixed in an axially rotatable manner inside the casing, the drum comprising a substantially cylindrical, tubular body having a front rim coupled in an axially rotatable manner to a front bulkhead and a rear rim coupled in axially rotatable manner to the rear wall;

a hot-air generator structured to circulate a stream of hot air through the drum;

a first circular sealing gasket interposed between the front rim and the front bulkhead;

a second circular sealing gasket interposed between the rear rim and the rear wall;

a substantially circular, basin-shaped lid or cover fixed to the rear wall, substantially coaxial to the tubular body, so as to form on the rear wall a cavity in communication with the hot-air generator; and a circular gasket-supporting collar having a nominal diameter greater than that of the rear rim and fixed, coaxial to the tubular body, to at least one of the rear wall and a periphery of the lid or cover, wherein the second circular sealing gasket is force fitted into the gasket-supporting collar so as to come in abutment against the periphery of the lid or cover around the perimeter thereof.

2. The rotary-drum laundry dryer of claim 1, wherein the rear wall includes a substantially sink-shaped bulge or recess which projects outwards on the casing, is located inside the perimeter of the second sealing gasket, and is in communication with the hot-air generator, and the lid or cover is fixed to the rear wall substantially coaxial to the tubular body, so as to close the bulge or recess.

3. The rotary-drum laundry dryer of claim 1, wherein the lid or cover is firmly fixed to the rear wall in substantially airtight manner.

4. The rotary-drum laundry dryer of claim 3, wherein an annular sealing gasket is interposed between the lid or cover and the rear wall.

5. The rotary-drum laundry dryer of claim 1, wherein at least a portion of the lid or cover is permeable to air so as to permit hot air to flow into and out of the drum.

6. The rotary-drum laundry dryer of claim 1, wherein at least a portion of the lid or cover is perforated.

7. The rotary-drum laundry dryer of claim 5, wherein a sink-shaped bulge or recess on the rear wall is substantially circular in shape and is substantially coaxial to the tubular body, and the lid or cover is fixed to the rear wall with its concavity facing the bottom of the bulge or recess, so as to form, on the rear wall, a substantially lenticular-shaped cavity.

8. The rotary-drum laundry dryer of claim 6, wherein a central section of a bottom of the lid or cover includes a substantially cup-shaped contra-oriented bulge or recess which projects towards a bottom of the bulge or recess on the rear wall.

9. The rotary-drum laundry dryer of claim 1, wherein the periphery of the lid or cover is fixed to the rear wall by at least one of seam-folding, clinching, riveting, spot-welding and a fixing technique similar to seam-folding, clinching, riveting or spot-welding.

10. The rotary-drum laundry dryer of claim 1, wherein the circular gasket-supporting collar is fixed to at least one of the rear wall and the periphery of the basin-shaped lid or cover by at least one of seam-folding, clinching, riveting, spot-welding and a fixing technique similar to seam-folding, clinching, riveting or spot-welding.

11. The rotary-drum laundry dryer of claim 1, wherein the circular gasket-supporting collar is realized in one piece with the lid or cover.

12. The rotary-drum laundry dryer of claim 1, wherein the second circular sealing gasket consists of a monolithic, toroidal-shaped ring made of rubber or other elastomeric polymer suitable to be force fitted into the circular gasket-supporting collar.

13. The rotary-drum laundry dryer of claim 12, wherein the toroidal-shaped ring has a hollow structure.

14. The rotary-drum laundry dryer of claim 1, wherein at least one of the circular gasket-supporting collar and the lid or cover is made of metal material.

15. The rotary-drum laundry dryer of claim 1, wherein the tubular body rests substantially horizontally inside the casing on substantially horizontally-oriented supporting rollers located close to both axial ends of the tubular body and fixed to the casing in a free revolving manner so as to allow the tubular body to freely rotate inside the casing about its horizontally-oriented longitudinal axis.

16. The rotary-drum laundry dryer of claim 1, wherein the outer casing comprises a lower supporting base or socle structured for resting on the floor and housing heat exchanging means adapted to dehydrate moisture laden air exiting the drum, the outer casing also comprises an upper cabinet structured for resting on the base or socle, the drum is fixed in axially rotatable manner inside the upper cabinet, the rear wall is a rear wall of the upper cabinet, and horizontally-oriented supporting rollers are fixed in free revolving manner directly to the base or socle.

* * * * *

UNITED STATES PATENT AND TRADEMARK OFFICE

CERTIFICATE OF CORRECTION

PATENT NO. : 8,516,716 B2
APPLICATION NO. : 13/208432
DATED : August 27, 2013
INVENTOR(S) : Deigo Dal Ben et al.

It is certified that error appears in the above-identified patent and that said Letters Patent is hereby corrected as shown below:

Title page, please insert:
--(30) Foreign Application Priority Data
Aug. 24, 2010 (EP).....10173866.4--

Signed and Sealed this
Eleventh Day of August, 2015

Michelle K. Lee

Michelle K. Lee
*Director of the United States Patent and Trademark Office*